United States Patent [19]

Giorgis

[11] Patent Number: 4,691,451

[45] Date of Patent: Sep. 8, 1987

[54] HAIR DRYER

[76] Inventor: Roberto Giorgis, Via Casilina Vecchia, 27, 00182 Roma, Italy

[21] Appl. No.: 930,058

[22] Filed: Nov. 12, 1986

Related U.S. Application Data

[63] Continuation of Ser. No. 663,747, Oct. 23, 1984, abandoned.

[30] Foreign Application Priority Data

Oct. 2, 1984 [IT] Italy ..... 48937 A/84

[51] Int. Cl.[4] ..... F26B 19/00

[52] U.S. Cl. ..... 34/68; 34/96; 34/97; 34/98; 416/100

[58] Field of Search ..... 34/4, 39, 97, 98, 99, 34/68, 222, 229; 416/100; 219/369, 370

[56] References Cited

U.S. PATENT DOCUMENTS

| | | | |
|---|---|---|---|
| 1,994,163 | 3/1935 | Augustus | 34/98 |
| 2,076,040 | 4/1937 | Norquist | 34/98 |
| 4,259,566 | 3/1981 | Kobayashi | 34/4 |

*Primary Examiner*—Larry I. Schwartz

*Attorney, Agent, or Firm*—Beveridge, DeGrandi & Weilacher

[57] ABSTRACT

A hair dryer comprising an electric motor 1 that places into rotation two or more arms 2 bearing at the ends thereof infra-red and hot air lamps 3, said lamps moving on a curved surface around the user's head due to a mechanism housed in supporting arm 5 and further comprising a sheave 7 with inclined plane, a cam 12 and a cam lever 20 for determining, when combined, a rotation motion of axis 10.

10 Claims, 4 Drawing Figures

HAIR DRYER

This application is a continuation of application Ser. No. 663,747, filed Oct. 23, 1984, now abandoned.

The present invention concerns a hair drier comprising infra-red and hot air lamps rotating around the user's head.

Actually, hot air driers and manual hair driers are well known which, however, show to be inadequate for the drying of many kinds of hair styles, as they don't leave the hair soft and shiny due to the static thermic source or to the excessive concentration of heat.

It is the aim of the present invention to dry the hair all around and softly, so as not to disturb even the more impatient user who doesn't like to keep her head under the hot air hair driers.

The present invention, as it is characterized in the claims, reaches the aim set forth realizing a hair drier with adjustable lamps comprising an electric motor that places into rotation two or more arms on which are applied and inclinable said infra-red and hot air lamps, characterized in a mechanism consisting in a sheave with inclined plane, in a cam and in a cam lever for modifying the inclination of the rotation axis of said arm, so as to obtain the movement of said lamps which are not bound to performing a plane circumference but move around the user's head touching all drying angles of the hair.

The advantages obtained by means of the present invention substantially consist in that the user doesn't have her head closed in a hot air hair drier but free, while the rotating lamps do not pass always on the same points but move along a nearly hemispherical surface thus uniformly distributing the heat.

The present invention will be described hereinafter more in detail relating to the attached drawings, in which a preferred embodiment is shown.

Figure 1:
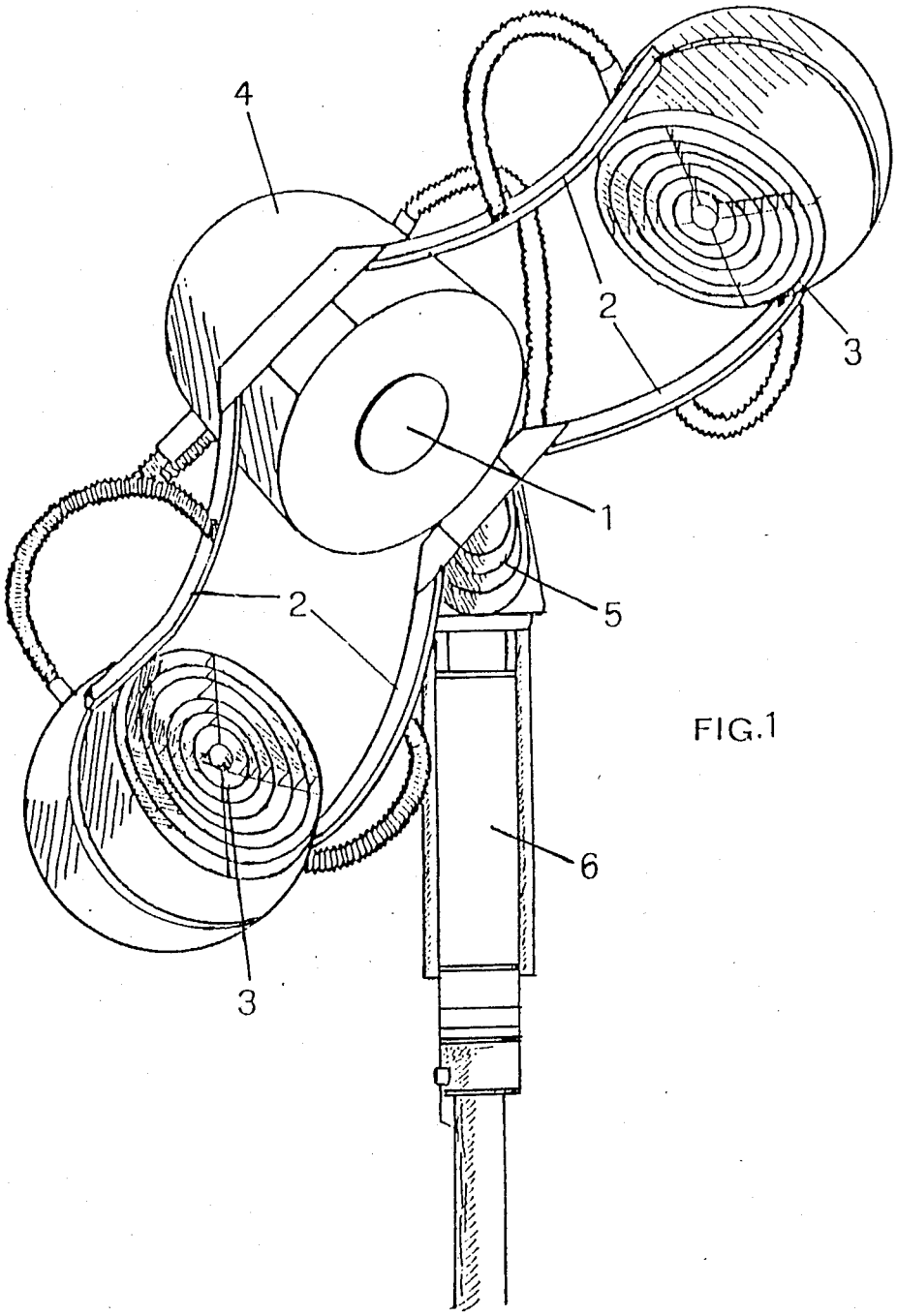
FIG. 1 is a perspective view of the hair drier device according to the present invention, in which two adjustable lamps are applied at the ends of two arms.

The figures show a hair drier device with rotating lamps substantially comprising an electric motor 1, the axis thereof bearing arms 2 with double structure, lamps 3 being pivoted at the ends thereof so as to be inclined according to the requests.

Said motor 1 is housed in container 4 and is moved and inclined by means of arm 5 placed on bearing structure 6.

Figure 2:
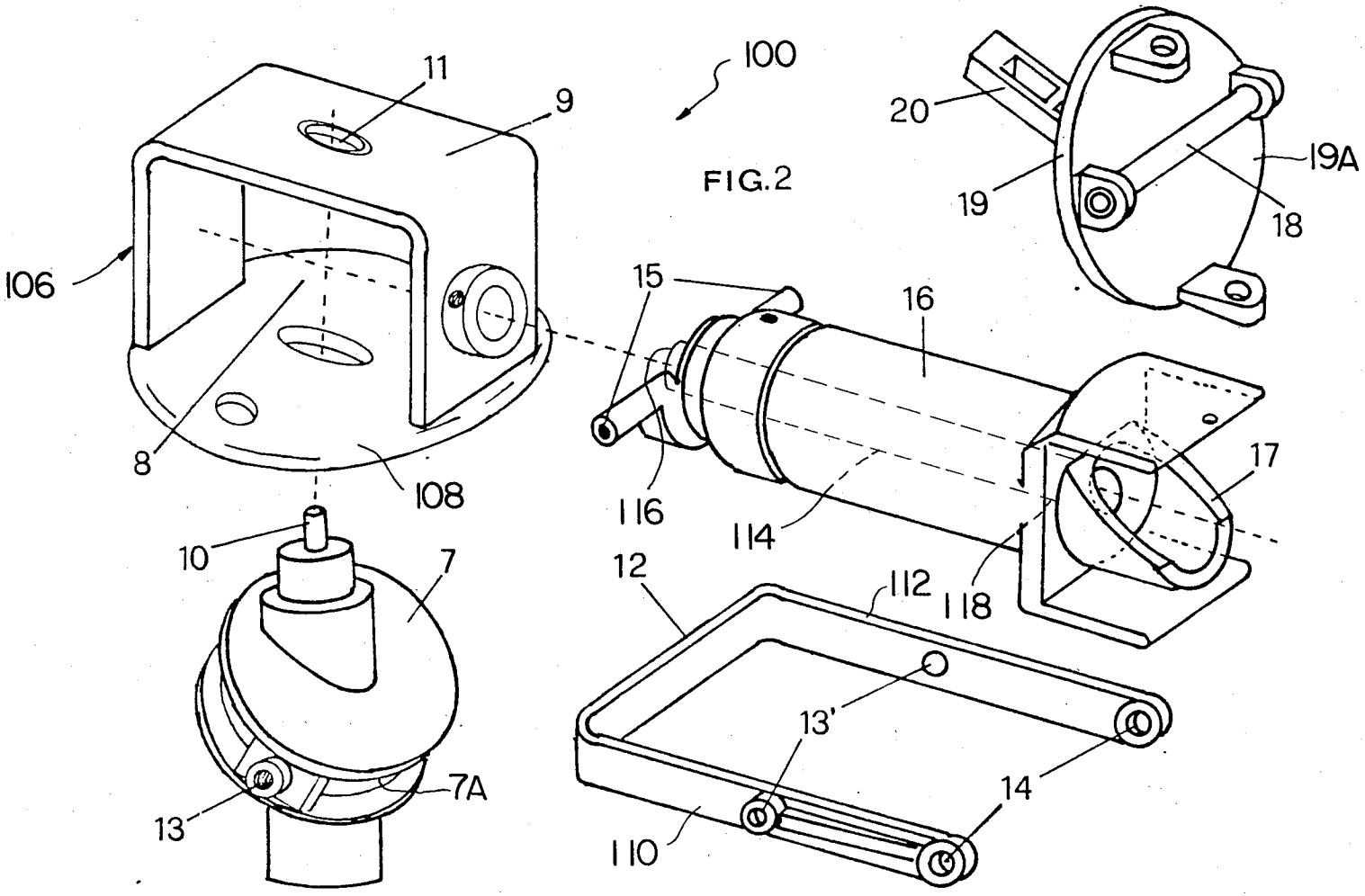
FIG. 2 is an axonometric exploded view of the mechanism for moving the lamps.

The mechanism 100 for transmitting the rotary motion produced by motor 1 is housed in arm 5. Mechanism 100 includes a head assembly 102 located on top of neck assembly 104. As shown in FIG. 2, the head assembly 102 includes a structure 106 having a U-shaped portion 9 and a plate portion 108 which together define an inner space 8. U-shaped portion 9 as a hole 11 therethrough. A pulley 7 having an inclined groove 7A therein is located in space 8 so that pin 10 of pulley 7 is journalled in and protrudes from hole 11.

A fork has opposing downwardly extending portions 110 and 112 wherein at 13' each of the downwardly extending portions supports a slide 13 that rides within groove 7A. Downwardly extending portions 110 and 112 terminate in ends 14 that rigidly connect to outwardly projecting portions 15 of the rocker arm 16 of neck assembly 104. Neck assembly 104 further includes a shaft 114 journalled within the rocker arm 16 as shown in broken lines in FIGS. 2–4. The structure 106 is connected to the upper end 116 of the shaft 114 while the opposite end 118 of the shaft protrudes downwardly from the rocker arm 16 and terminates in a flat inclined cam 17.

Figure 3:
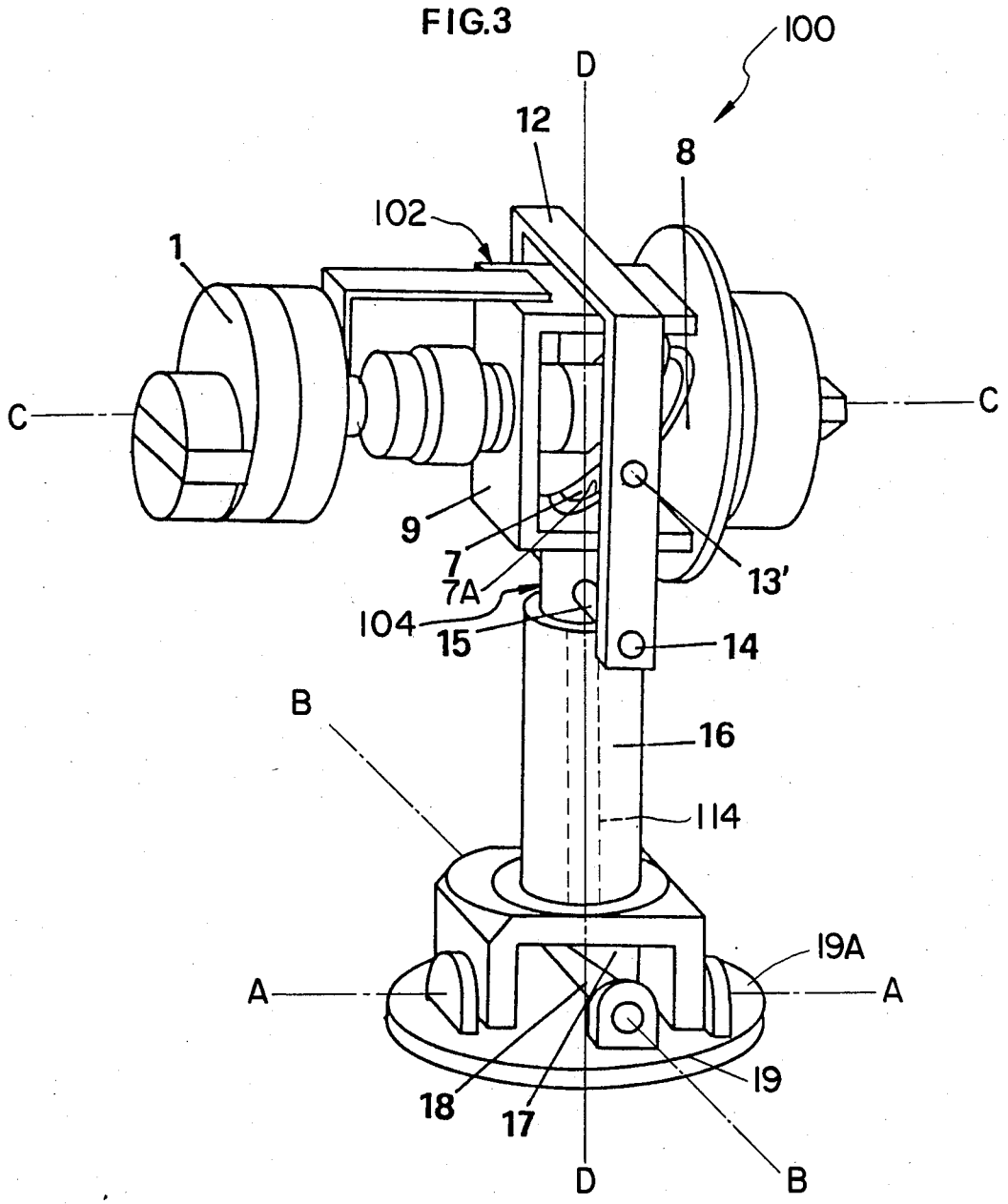
FIG. 3 is a perspective view of the mechanism for moving the lamps.
Figure 4:
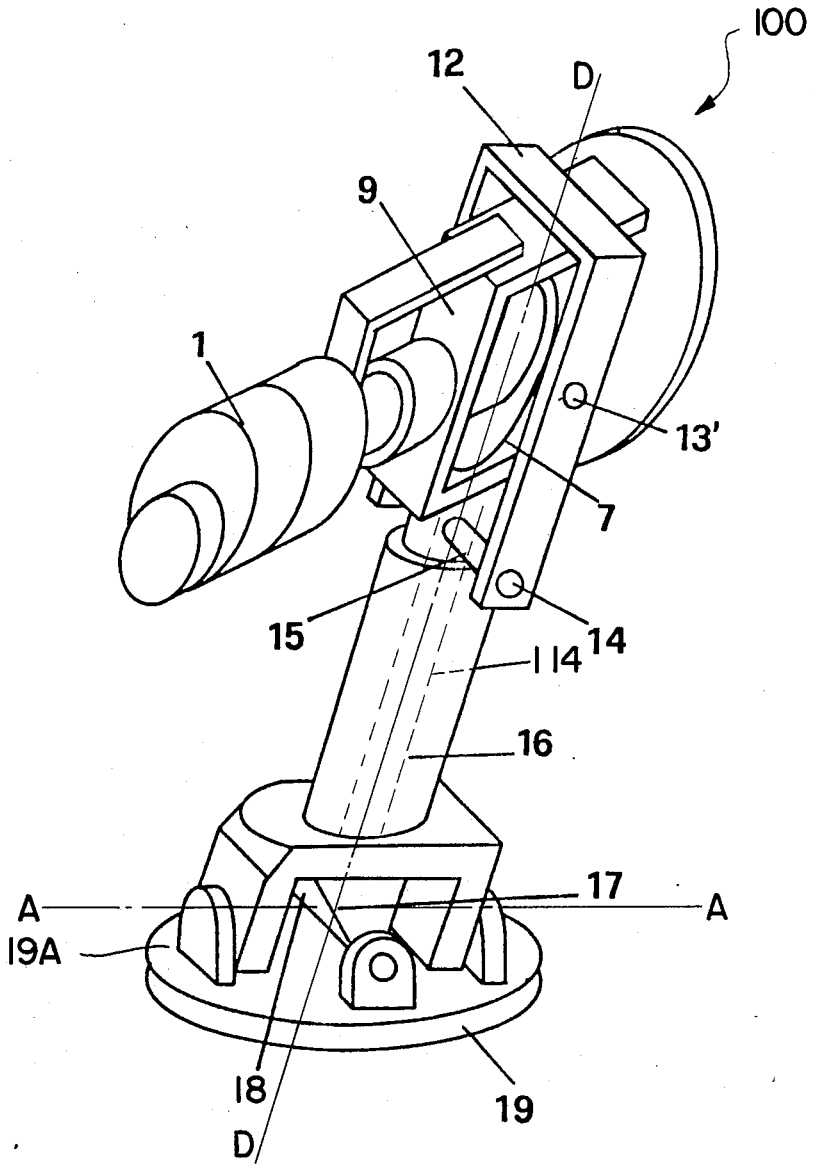
FIG. 4 is a view, similar to FIG. 3, wherein the mechanism for moving the lamps is shown as tilted.

As shown in FIG. 2, the cam 17 contacts a transverse arm 18 located on the upper face 19A of the base plate 19. The rocker arm 16 is also pivotally connected to plate 19 for pivotal movement about axis A—A as shown in FIGS. 3 and 4. The transverse arm 18 is rigidly mounted on the plate 19 and it extends along the axis B—B, orthogonal to line A—A. The axis of rotation of pin 10 and pulley 7 is indicated by line C—C. Lever 20 is connected to the lower face of plate 19 in a manner to be described in the following.

Motor 1 causes rotation of pin 10 and pulley 7. As pulley 7 rotates, sliders 13 slide within groove 7A and, due to the inclination of the groove, this causes the pin 10, the motor 1, arm 2, and lamp 3 to oscillate or reciprocally pivot about the longitudinal axis D—D of the rocker arm 16.

Rotation of the pulley 7 further causes pivotal oscillations of the fork 12 and its connected cam 17 with respect to the rocker arm 16 and the transverse arm 18 of base plate 19. This causes the cam 17 to turn and, due to its contact with transverse arm 18 of plate 19, the rocker arm 16 will oscillate or pivot back and forth about the axis A—A. The combined motion of pin 10, and therefore all of mechanism 100, motor 1, arms 2 and lamps 3 provides the hair drier apparatus of the present invention with motion along a spatial, curved surface in a nutation motion of axis 10, wherein the lower projection thereof is always fixed in the work zone where the user's head is located.

Describing the mechanism and its operation in other terms, it will be noted that it comprises rigid assemblies which move relative to each other. The first such assembly of rigidly interconnected members includes the rocker arm 16, portions 14, yoke 12, and the sliders 13. This assembly is connected to the base 19 for pivotal movement about a second axis A—A which is transverse to a first axis, the longitudinal axis D—D of the rocker arm.

The second assembly of rigidly interconnected members includes the lamps 3, arms 2, shaft 114, the elements 9, 106, 108 which also include the sheave bearings, and the cam 17 at the lower end of the shaft 114. Bearings on the yoke 106 support the sheave 7 for rotation about a third axis C—C which is transverse to the axis D—D. Since the sheave 7 is inclined relative to its rotational axis C—C, the rotation of the sheave will act on the sliders 13 to rotate the shaft 114 within the rocker arm 16, causing the cam 17 to rotate against the surface of member 18 to tilt the rocker arm about the axis A—A, thereby changing the inclination of the axis D—D.

Thus, the sheave 7 and sliders 13 provide a means for rotating the lamps on the second assembly about the first axis D—D; and, the cam 17 acts on the stationary surface 18 to provide a means for changing the inclination of the axis D—D. The simultaneous operation of these means moves the lamps around a user's head in an arcuate path which is not located in a flat plane.

I claim:

1. A hair drying apparatus for drying hair on a person's head comprising:

an electric motor;

a plurality of hair drying lamps for drying the hair;

arms for supporting said lamps;

a mechanism for transmitting motion from said motor to said arms and said lamps, said mechanism including a head assembly having a first support means, a grooved pulley journalled in said first support means, second support means, a slide means supported by said second support means and lying within said groove, said first support means being pivotal with respect to said second support means, a neck assembly connected to said head assembly, said neck assembly including a rocker arm rigidly fixed to said second support means and a cam rigidly fixed to said first support means; and base means for supporting the rocker arm for pivotal movement about an axis which is transverse to the rocker arm, said base means having a surface rigidly fixed thereto for contacting said cam, said motor causing said grooved pulley to rotate whereby said mechanism moves said arms and said lamps around the head and hair to direct the lamps toward different areas of the hair on the head.

2. A hair drying apparatus as claimed in claim 1 wherein said first support means comprises a U-shaped member having an inner space and a hole therein, said grooved pulley having a pin, said pulley being located in said space with said pin being journalled in said hole and projecting outwardly therefrom along a first axis, said second support means comprising a fork having two downwardly extending portions, said slide means comprising sliders connected to each of said downwardly extending portions of the fork, said rocker arm having outwardly projecting portions connected to the ends of said downwardly extending portions of the fork whereby upon rotation of said grooved pulley and said pin by said motor, said sliders slide within said groove and due to the inclination of said groove, said motor, pin, arms and lamps oscillate in planes which are normal to said rocker arm.

3. A hair drying apparatus as claimed in claim 1, wherein said base means comprises a transverse arm, said surface for contacting said cam being on said transverse arm; said motion by said motor being translated by said grooved pulley and slide means into pivotal motion of said first support means and the cam relative to said second support means, said rocker arm being pivotally connected to said base means whereby, when said cam is pivoted, said cam causes said rocker arm to oscillate about its pivotal connection with said base means.

4. A hair dryer apparatus as claimed in claim 1 wherein said base means has an upper face and a lower face, said surface for contacting said cam being on said upper face and a cam lever being connected to said lower face thereof, said lever being eccentrically and pivotably connected to said lower face to provide for lifting or lowering of said rocker arm.

5. A hair drying apparatus as claimed in claim 2, wherein said base means further comprises a transverse arm along a second axis, said surface for contacting said cam being on said transverse arm, said motion by said motor being translated by said grooved pulley and slider into pivotal motion of said first support means and cam relative to said second support means, said rocker arm being pivotally connected to said base to pivot about a third axis whereby pivotal movement of the cam produces oscillating movement of said rocker arm about said third axis.

6. A hair drying apparatus as claimed in claim 5, wherein said first and said third axes fall within a common plane and said second axis is orthogonal to said first and third axes.

7. A hair dryer apparatus as claimed in claim 5 wherein said base means has an upper face and a lower face, said transverse arm being on said upper face, and a cam lever being eccentrically and pivotably connected to said lower face to provide for lifting or lowering of said rocker arm.

8. Hair drier apparatus for drying the hair of a user, comprising, a plurality of arms, hair drying lamps mounted on said arms, first means for rotating said arms about a first axis, said first means including a sheave engaged with a slider, said sheave being rotatable with respect to said slider, second means for changing the inclination of the first axis, said second means including a cam surface engaged with a stationary member, said second means being operable simultaneously with the first means to move the lamps around the user's head in an arcuate path which is not located in a flat plane.

9. Hair drier apparatus according to claim 8 wherein the sheave is rotatable about a rotational axis which is fixed with respect to the arms, said sheave lying in a plane which is inclined relative to said rotational axis.

10. Hair drier apparatus according to claim 8 comprising, a base having a cam engaging surface thereon, a first assembly of rigidly interconnected members including a rocker arm, a yoke, and said slider mounted on the yoke, said rocker arm being aligned with and nonrotatable with respect to said first axis, said rocker arm being connected to the base for pivotal movement about a second axis which is transverse to said first axis, a second assembly of rigidly interconnected members including a shaft which is aligned with and rotatable with respect to said first axis, bearing means for supporting the sheave at one end of the second arm for rotation about a third axis which is transverse to the first axis, said sheave being inclined with respect to said third axis so that rotation of the sheave will act on said slider to rotate the shaft relative to the rocker arm, said cam being affixed to said shaft and being in contact with said stationary member so that rotation of said shaft will turn said cam to change the inclination of the first axis.

* * * * *